US010148003B2

(12) United States Patent
Ando et al.

(10) Patent No.: US 10,148,003 B2
(45) Date of Patent: Dec. 4, 2018

(54) ANTENNA DEVICE

(71) Applicant: KABUSHIKI KAISHA TOKAI RIKA DENKI SEISAKUSHO, Aichi (JP)

(72) Inventors: Takahiko Ando, Aichi (JP); Masateru Huruta, Aichi (JP); Shinji Hasegawa, Aichi (JP)

(73) Assignee: KABUSHIKI KAISHA TOKAI RIKA DENKI SEISAKUSHO, Aichi (JP)

( * ) Notice: Subject to any disclaimer, the term of this patent is extended or adjusted under 35 U.S.C. 154(b) by 8 days.

(21) Appl. No.: 15/239,161

(22) Filed: Aug. 17, 2016

(65) Prior Publication Data

US 2017/0062915 A1 Mar. 2, 2017

(30) Foreign Application Priority Data

Aug. 26, 2015 (JP) ..... 2015-166904

(51) Int. Cl.

| | |
|---|---|
| ***H01Q 1/32*** | (2006.01) |
| ***H01Q 7/08*** | (2006.01) |
| ***H01F 27/32*** | (2006.01) |
| ***H01Q 7/00*** | (2006.01) |
| ***H01Q 7/06*** | (2006.01) |

(52) U.S. Cl.

CPC ..... *H01Q 1/3233* (2013.01); *H01F 27/325* (2013.01); *H01Q 1/3241* (2013.01); *H01Q 1/3275* (2013.01); *H01Q 1/3291* (2013.01); *H01Q 7/00* (2013.01); *H01Q 7/06* (2013.01); *H01Q 7/08* (2013.01)

(58) Field of Classification Search

CPC ..... H01Q 7/06; H01Q 7/08; H01Q 1/3275; H01Q 1/3283; H01Q 7/00; H01Q 1/3233; H01Q 1/3291; H01Q 1/3241; H01F 27/325

See application file for complete search history.

(56) References Cited

U.S. PATENT DOCUMENTS 5,990,841 A * 11/1999 Sakamoto ..... H01Q 1/362 343/749
6,052,097 A * 4/2000 Duncan ..... H01Q 1/273 343/718

(Continued)

FOREIGN PATENT DOCUMENTS

| | | |
|---|---|---|
| JP | 2008-78899 | 4/2008 |
| JP | 4134173 | 8/2008 |

OTHER PUBLICATIONS

Japanese Office Action for JP App. No. 2015-166904 dated Jun. 27, 2017, along with English-language translation thereof.

*Primary Examiner* — Dameon E Levi
*Assistant Examiner* — Ab Salam Alkassim, Jr.
(74) *Attorney, Agent, or Firm* — Greenblum & Bernstein, P.L.C.

(57) ABSTRACT

An antenna device includes a bar-shaped core, a bobbin into which the core is fitted, and a case that accommodates the bobbin and holds the core. The bobbin includes a resilient portion that bends and biases the core toward an inner side of the bobbin when interference occurs with an inner surface of the case. The resilient portion is configured to hold the core with friction force obtained when contacting the core and relieve impact force applied to the core while producing friction with the core.

6 Claims, 2 Drawing Sheets

(56) References Cited

U.S. PATENT DOCUMENTS 7,095,381 B2 * 8/2006 Kimura ..... H01Q 1/3241 343/788
7,204,136 B2 * 4/2007 Thrush ..... B60C 23/0408 73/146.2
7,425,929 B2 * 9/2008 Sako ..... H01Q 7/08 343/787
7,427,963 B2 * 9/2008 Moriya ..... H01Q 7/08 343/713
7,522,117 B2 * 4/2009 Takahashi ..... G04G 21/04 343/787
7,598,915 B2 * 10/2009 Ieda ..... B60R 25/246 343/713
7,969,272 B2 * 6/2011 Brinlee ..... H01F 27/255 336/182
8,358,250 B2 * 1/2013 Sako ..... H01Q 1/40 343/713
8,420,188 B2 * 4/2013 Kawashima ..... B29C 65/56 340/5.64
8,552,827 B2 * 10/2013 Kudo ..... H01F 27/34 336/199
8,872,621 B2 * 10/2014 Miura ..... H03K 17/962 340/426.28
9,033,379 B2 * 5/2015 Tateishi ..... E05B 85/16 292/336.3
9,164,125 B2 * 10/2015 Tsurumaki ..... E05B 81/77
9,353,557 B2 * 5/2016 Sanborn ..... E05B 85/14
9,407,009 B2 * 8/2016 Mahara ..... H01Q 7/00
9,437,927 B2 * 9/2016 Koga ..... H01Q 7/08
9,556,655 B2 * 1/2017 Shimizu ..... E05B 81/76
9,768,509 B2 * 9/2017 Tanaka ..... H01Q 7/00
9,768,510 B2 * 9/2017 Tanaka ..... H01Q 1/3241
9,997,835 B2 * 6/2018 Tabata ..... H01F 5/02
10,049,805 B2 * 8/2018 Kobayashi ..... H01F 27/022
2002/0033777 A1 * 3/2002 Maruyama ..... H01Q 1/241 343/713
2003/0063037 A1 * 4/2003 March ..... H01Q 1/3241 343/711
2005/0219139 A1 * 10/2005 Kimura ..... H01Q 1/3241 343/788
2006/0164311 A1 * 7/2006 Ieda ..... H01Q 1/20 343/713
2006/0214866 A1 * 9/2006 Araki ..... G04G 21/04 343/788
2007/0075913 A1 * 4/2007 Moriya ..... H01Q 7/08 343/895
2007/0096905 A1 * 5/2007 Ieda ..... B60R 25/246 340/562
2007/0139288 A1 * 6/2007 Shigemoto ..... H01Q 1/3241 343/788
2008/0068129 A1 * 3/2008 Ieda ..... B60R 25/246 340/5.72
2010/0164822 A1 * 7/2010 Iwasaki ..... H01Q 1/3241 343/788
2011/0215987 A1 * 9/2011 Ohara ..... H01Q 1/50 343/906
2012/0133563 A1 * 5/2012 Naka ..... E05B 81/77 343/713
2014/0361949 A1 * 12/2014 Mahara ..... H01Q 7/00 343/866
2015/0116171 A1 * 4/2015 Koga ..... H01Q 7/08 343/788
2016/0093954 A1 * 3/2016 Tabata ..... H01F 5/02 343/788
2016/0315389 A1 * 10/2016 Imai ..... H01Q 1/52
2017/0104272 A1 * 4/2017 Miura ..... H01Q 1/36
2017/0155188 A1 * 6/2017 Kikuchi ..... H01Q 1/3283
2017/0263368 A1 * 9/2017 Kobayashi ..... H01F 27/022
2017/0310011 A1 * 10/2017 Tanaka ..... H01Q 7/00
2017/0372827 A1 * 12/2017 Kobayashi ..... H01F 5/02

* cited by examiner

A (Impact Force) : W
B (Pushing Force) : W1
C (Friction Force) : W2

ANTENNA DEVICE

CROSS-REFERENCE TO RELATED APPLICATIONS

This application is based upon and claims the benefit of priority from prior Japanese Patent Application No. 2015-166904, filed on Aug. 26, 2015, the entire contents of which are incorporated herein by reference.

BACKGROUND ART

The present invention relates to an antenna device includes a bar-shaped core.

Japanese Patent No. 4134173 describes an example of a low-frequency antenna device including a bar-shaped ferrite core.

A damper formed from silicone or rubber is attached to the ferrite core to increase the drop impact resistance of the ferrite core.

There is a need to increase the drop impact resistance of the ferrite core without using a damper so that costs can be reduced.

It is an object of the present invention to provide an antenna device that increases the drop impact resistance without using a damper.

SUMMARY OF THE INVENTION

One aspect of the present invention is an antenna device including a bar-shaped core, a bobbin into which the core is fitted, and a case that accommodates the bobbin and holds the core. The bobbin includes a resilient portion that bends and biases the core toward an inner side of the bobbin when interference occurs with an inner surface of the case. The resilient portion is configured to hold the core with friction force produced when contacting the core, and the resilient portion is configured to relieve impact force applied to the core while producing friction with the core.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

EMBODIMENTS OF THE INVENTION

One embodiment of an antenna device will now be described. The antenna device of the present invention is located in a passenger compartment of a vehicle and used for low frequencies. To establish bidirectional wireless communication between the vehicle and an electronic key, the vehicle transmits radio waves in the low frequency (LF) band. The radio waves trigger communication and form a smart communication area around the vehicle.

Figure 1:
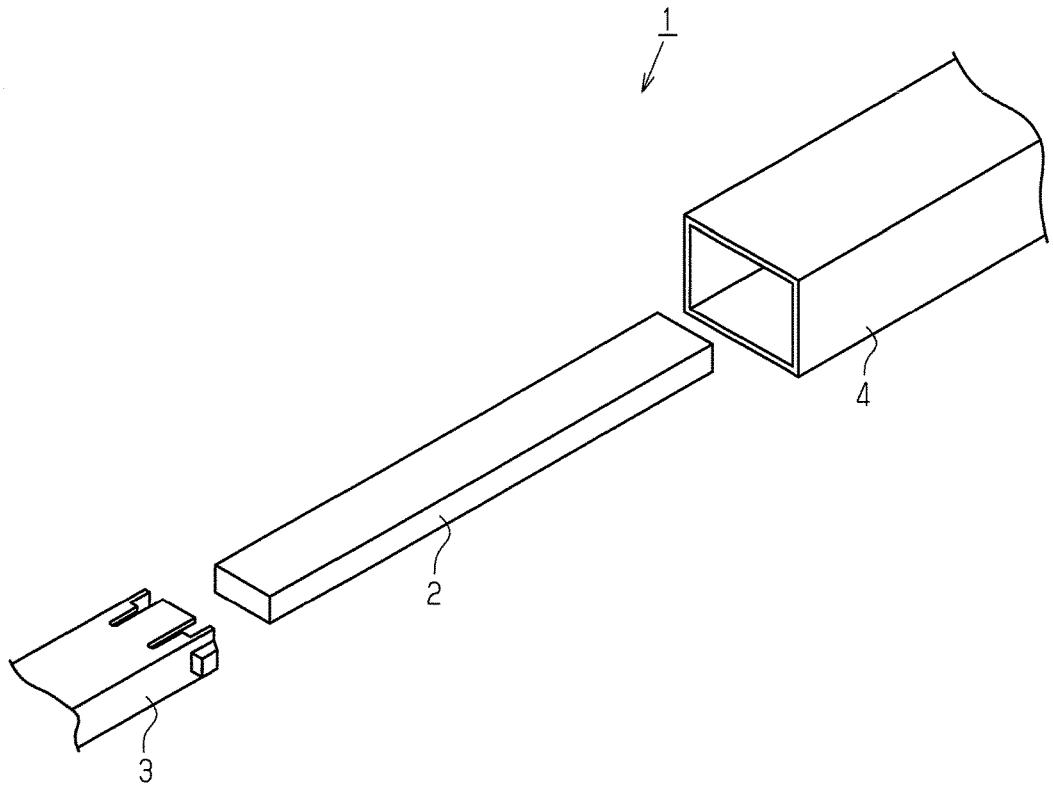
FIG. 1 is an exploded perspective view schematically showing the structure of an antenna device.

Referring to FIG. 1, in the antenna device 1, a bar-shaped core 2 is fitted into a bobbin 3, and the bobbin 3 is accommodated in a case 4. Thus, the core 2 is held in the case 4. The core 2, which is formed from a magnetic material such as ferrite, has a rectangular cross-sectional. The thickness of the core 2 is approximately one-half of the width of the core 2. The core 2 is longer than it is wide. The bobbin 3, which is formed from an insulative material, has a rectangular frame-like cross section. An antenna coil (not shown) is wound around a certain portion of the bobbin 3. The case 4, which is formed from an insulative resin, has a rectangular frame-like cross section that is larger than the bobbin 3.

Figure 2:
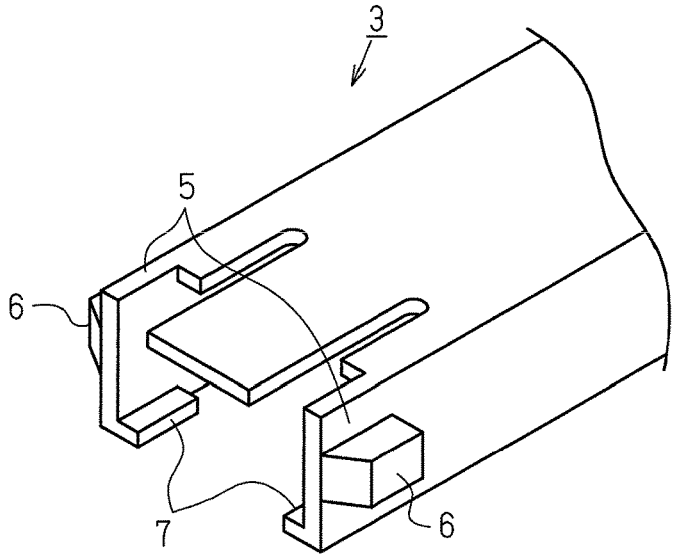
FIG. 2 is a perspective view showing a core holding portion of a bobbin.

As shown in FIG. 2, the bobbin 3 includes an open end, an upper wall, a lower wall, and two side walls. The upper wall includes two slits extending from the open end near the two side walls. The lower wall includes an opening extending from the open end. In this structure, the two side walls each function as a resilient portion 5. The resilient portion 5 includes an outer projection 6 and an inner support 7. The bobbin 3 is fitted into the case 4 with each projection 6 in interference with the corresponding side wall. The distance between the outer end surfaces (interference surfaces) of the projections 6 before the bobbin 3 is fitted to the case 4 is set to be longer than the distance between the corresponding side walls of the case 4. The interference of the bobbin 3 with the case 4 bends and biases the two resilient portions 5 toward the inner side of the core 2. The two resilient portions 5 cooperate to produce friction force obtained by contacting the core 2 and hold the core 2 with the friction force. When the antenna device falls and an impact force exceeding the friction force is applied to the core 2, movement of the core 2 is permitted about the supports 7.

The operation of the antenna device 1 will now be described.

Figure 3:
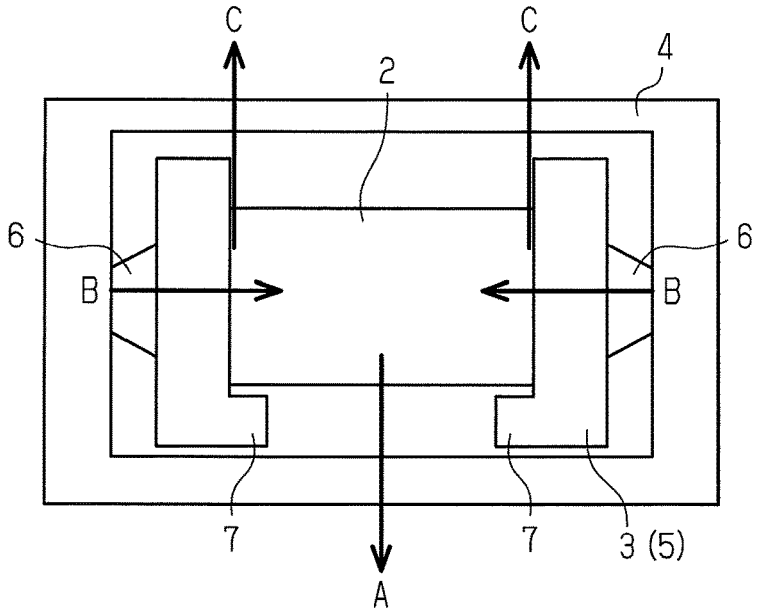
FIG. 3 is a diagram illustrating the principle for holding a core.

Referring to FIG. 3, the core 2 is fitted into the bobbin 3, and the bobbin 3 is fitted into the case 4. This results in interference of the projections 6 with the case 4 that bends and biases the resilient portions 5 toward the core 2. The biasing force acting toward the inner side of the case 4 in the direction indicated by arrow B is referred to as a pushing force W1. The pushing force W1 is adjusted by the amount of interference between the case 4 and the projections 6. The pushing force W1 acting between the core 2 and the bobbin 3 obtains a friction force W2 acting toward the upper side in the direction indicated by arrow C. The friction force W2 holds the core 2.

When the antenna device falls and an impact force W acting toward the lower side as indicated by arrow A exceeds the friction force W2, the friction force W2 holding the core 2 offsets a proportion of the impact force W. The difference between the impact force W and the friction force W2 produces a force (W−W2) that moves the core 2 about the supports 7 while producing friction with the bobbin 3. This consumes a proportion of the impact force W as kinetic energy. In this manner, the resilient portions 5 relieve the impact force W and reduce the impact force W that is applied to the core 2.

The present embodiment has the advantages described below.

(1) The resilient portions 5 of the bobbin 3 hold the core 2. When the antenna device falls and impact force is applied to the core 2, friction produced between the core 2 and the resilient portions 5 relieves the impact force. This avoids damage to the core 2 that would be caused by the impact produced when the antenna device falls. Further, there is no need for a separate component such as a damper to be attached to the core 2. Thus, the drop impact resistance can be increased without using a damper.

(2) The resilient portions 5 permit movement of the core 2 while producing friction with the core 2. This relieves the impact force applied to the core 2. In this structure, a proportion of the impact force is consumed as kinetic energy of the core 2. This reduces the impact force and increases the drop impact resistance.

(3) The resilient portions 5 allow the force resulting from the difference of the impact force W, which exceeds the friction force W2, and the friction force W2 to move the core 2. In this structure, the core 2 moves after the friction force W2 holding the core 2 offsets a proportion of the impact force W. This reduces the acceleration of the core 2 and avoids damage to the core 2.

It should be apparent to those skilled in the art that the present invention may be embodied in many other specific forms without departing from the spirit or scope of the invention. Particularly, it should be understood that the present invention may be embodied in the following forms.

Instead of using the core 2 that has the form of a polygonal bar, a core having the form of a round bar may be used. In this case, the surface of each resilient portion 5 is curved to obtain the desired friction force when contacting the core. When the antenna device falls, the impact applied to the core allows the core to rotate while producing friction with the resilient portions 5. A proportion of the impact force is consumed as kinetic energy of the rotation.

The antenna device according to the present invention is not limited to an LF antenna device used for smart communication.

The present examples and embodiments are to be considered as illustrative and not restrictive, and the invention is not to be limited to the details given herein, but may be modified within the scope and equivalence of the appended claims.

What is claimed is:

1. An antenna device comprising:

a bar-shaped core;

a bobbin into which the core is fitted; and a case that accommodates the bobbin and holds the core, wherein the bobbin includes two resilient portions that are defined by two opposing portions of the bobbin that are configured to hold the core, a slit that is arranged between the two resilient portions to permit bending of the two resilient portions, and an inner support that is arranged at a lower side of a position where the two resilient portions hold the core, the two resilient portions bend and bias the core toward an inner side of the bobbin when interference occurs with an inner surface of the case, the two resilient portions hold the core with a friction force produced when contacting the core, and when an impact force is applied to the core, the two resilient portions relieve the impact force while producing friction with the core.

2. The antenna device according to claim 1, wherein when the impact force is applied to the core, the resilient portion relieves the impact force by permitting movement of the core while producing friction with the core.

3. The antenna device according to claim 2, wherein the resilient portion moves the core with a resultant force obtained from a difference of a threshold impact force, which exceeds the friction force, and the friction force.

4. The antenna device according to claim 1, wherein the slit extends from an open end of the bobbin to a position between the two resilient portions.

5. An antenna device comprising:

a bar-shaped core;

a bobbin into which the core is fitted; and a case that accommodates the bobbin and holds the core, wherein the bobbin includes a resilient portion that bends and biases the core from an outer side toward an inner side in a horizontal direction of the bobbin when interference occurs with an inner surface of the case, the resilient portion holds the core with a friction force produced toward an upper side of the bobbin when contacting the core, the resilient portion includes an inner support that is arranged at a lower side of a position where the resilient portion holds the core, the resilient portion is configured to relieve impact force applied to the core by permitting movement of the core about the inner support in a vertical direction of the bobbin while producing friction with the core, and the resilient portion is configured to move the core about the inner support with a force obtained from a difference of an impact force, which exceeds the friction force, and the friction force to consume a proportion of the impact force.

6. The antenna device according to claim 5, wherein the resilient portion is one of two resilient portions, the two resilient portions are defined by two opposing portions of the bobbin, and the two resilient portions hold the core.

* * * * *